US011777203B2

(12) United States Patent
Karch et al.

(10) Patent No.: US 11,777,203 B2
(45) Date of Patent: Oct. 3, 2023

(54) ASYMMETRICALLY CONSTRUCTED RADOME

(71) Applicant: Airbus Defence and Space GmbH, Taufkirchen (DE)

(72) Inventors: Christian Karch, Taufkirchen (DE); Johannes Wolfrum, Taufkirchen (DE)

(73) Assignee: Airbus Defence and Space GmbH

( * ) Notice: Subject to any disclaimer, the term of this patent is extended or adjusted under 35 U.S.C. 154(b) by 0 days.

(21) Appl. No.: 17/698,108

(22) Filed: Mar. 18, 2022

(65) Prior Publication Data

US 2022/0311134 A1 Sep. 29, 2022

(30) Foreign Application Priority Data

Mar. 25, 2021 (DE) ..... 10 2021 107 538.6

(51) Int. Cl.
*H01Q 1/42* (2006.01)
*H01Q 1/28* (2006.01)

(52) U.S. Cl.
CPC ..... *H01Q 1/422* (2013.01); *H01Q 1/281* (2013.01)

(58) Field of Classification Search
CPC ..... H01Q 1/42; H01Q 1/422; H01Q 1/28; H01Q 1/281
See application file for complete search history.

(56) References Cited

U.S. PATENT DOCUMENTS

| | | | | |
|---|---|---|---|---|
| 5,408,244 A * | 4/1995 | Mackenzie | ..... | H01Q 1/422 343/873 |
| 6,028,565 A | 2/2000 | Mackenzie et al. | | |
| 6,107,976 A | 8/2000 | Purinton | | |
| 2020/0058991 A1 | 2/2020 | Adugna et al. | | |

FOREIGN PATENT DOCUMENTS

| | | | | |
|---|---|---|---|---|
| DE | 102016221143 A1 | 5/2018 | | |
| EP | 2747202 A1 * | 6/2014 | ..... | H01Q 1/422 |
| WO | 9212550 A1 | 7/1992 | | |
| WO | WO-2018077823 A1 * | 5/2018 | ..... | H01Q 1/28 |

OTHER PUBLICATIONS

Extended European Search Report for Application No. 22158594.6 dated Aug. 4, 2022, 3 pages. [See p. 2, categorizing the cited references].

* cited by examiner

*Primary Examiner* — Hoang V Nguyen
(74) *Attorney, Agent, or Firm* — Lerner David LLP

(57) ABSTRACT

An asymmetrically constructed radome for an aircraft and an aircraft having an antenna and a corresponding radome are described. The radome has a first layer with a first dielectric constant and a first layer thickness, and a second layer with a second dielectric constant and a second layer thickness. The first layer thickness and the second layer thickness are different from each other. The first layer includes a thermosetting material and the second layer includes a thermoplastic material. Such an asymmetrical radome structure improves the mechanical stability and electromagnetic transparency of the radome.

11 Claims, 2 Drawing Sheets

ASYMMETRICALLY CONSTRUCTED RADOME

FIELD OF THE INVENTION

The present disclosure relates to radomes for protecting antennas, in particular for protecting antennas or transmitting and receiving devices mounted on aircraft.

BACKGROUND OF THE INVENTION

In order to protect antennas in ground, aviation and space-flight applications from external influences or from environmental influences, use is made of radomes which cover the antenna. Radomes of this type must have the necessary mechanical stability to withstand the loads arising from external influences and must also be as transparent as possible to electromagnetic signals in at least one selected frequency range in order not to influence the functioning of the covered antenna more than necessary. Particularly in aviation applications, radomes must have a high mechanical stability in order, for example, to withstand bird strikes or the high air pressures during flight, ensuring that the antenna is not damaged. For phase-sensitive applications such as, for example, in monopulse, interferometric or coherent phase change detection systems, high requirements must also be placed on the electromagnetic properties to prevent the signal from being excessively distorted by the radome. In this case, the entry phase delay is also dependent on the entry angle. Moreover, the properties of a radome with respect to transparency for electromagnetic waves are, in particular, also a function of the frequency of the electromagnetic waves, and antennas are increasingly being operated in different frequency ranges for the transmission mode and the reception mode. This makes it increasingly difficult to meet the requirements on radomes.

In the prior art, radomes are constructed in a symmetrical manner from layers, for example, that is to say the various layers are of symmetrical construction with respect to a central plane, both with regard to the electromagnetic properties and the layer thicknesses.

BRIEF SUMMARY OF THE INVENTION

An aspect of the invention may relate to improve the mechanical and electromagnetic properties of radomes According to a first aspect, a radome for an aircraft is made available. The radome has a first layer with a first dielectric constant and a second layer with a second dielectric constant. The first layer and the second layer have different first and second layer thicknesses. The first layer comprises a thermosetting material and the second layer comprises a thermoplastic material.

The first layer corresponds to the side of the radome which, in the installed state of the radome, faces outward, away from the antenna. This layer is directly exposed to the environmental influences and, in particular, has to withstand mechanical loads, such as the aerodynamic loads during the flight of an aircraft, weather conditions such as hail, dynamic loads such as bird strikes or other external influences.

The second layer corresponds to the side of the radome which, in the installed state of the radome, faces inward, toward the antenna, and is not directly exposed to environmental pollution. Accordingly, this layer must withstand mechanical loads to a lesser extent than the first layer, for example. However, transmitted signals of the antenna are introduced into the radome via the second layer, and signals received by the antenna emerge from the second layer of the radome before they reach the antenna. The second layer thus represents an electromagnetic interface between the radome and the air space between the antenna and the radome.

Since the first layer faces outward and must withstand the external environmental conditions and mechanical loads, the first layer thickness is determined substantially by the material used and by the corresponding loads which the radome must withstand. In other words, a certain minimum thickness is required for the first layer so that it can withstand the mechanical loads from the outside. Among other things, the material used determines the minimum thickness of the first layer. Since the first layer must also withstand weather conditions, the choice of material for this layer is limited. For example, as described further below with respect to various embodiments, the first layer can comprise a thermosetting material and glass fibers. However, other materials are also conceivable.

The second layer, on the other hand, is on the inner side of the radome (facing the antenna) and has to withstand mechanical loads to a correspondingly lesser extent than the first layer (facing away from the antenna). This allows a greater choice of materials than with the first layer. In particular, the second layer thickness and the second dielectric constant can be selected so that the electromagnetic transparency together with the first layer is improved for the intended frequency ranges, and the dielectric losses are minimized. In other words, by selecting a suitable dielectric constant and a suitable layer thickness of the second layer, the phase path of the electromagnetic signal through the radome can in this way be adapted to the signal used in order to reduce dielectric losses and improve electromagnetic transparency.

The layer thicknesses of the first layer and of the second layer and of all additional layers described further below with reference to further embodiments can be constant over the entire cross section of the radome. However, the layer thicknesses can also be tapered in places in order in this way to take into account the entry and exit angles of the electromagnetic radiation of the antenna at various points on the radome and thereby improve or maintain performance over the entire radome.

Plastics are divided into thermosetting plastics, elastomers and thermoplastics. A thermosetting material (also referred to as a thermosetting plastic) is a plastic which, after curing, is three-dimensionally crosslinked and can no longer be converted to the molten state by heating or other measures. Such a thermosetting material initially has a high mechanical strength but breaks when certain loads are exceeded. The energy of an impact of an object on a thermosetting material is not or is hardly absorbed by the latter but is passed on almost completely. For this reason, such a material is well suited as an outer layer of a radome, particularly for aircraft, because it can withstand a bird strike or hail, for example, without being permanently deformed.

When this disclosure refers to thermosetting materials, these may comprise cyanate ester resins or epoxy resins reinforced with short or continuous quartz or glass fibers, for example and without being limited thereto.

A thermoplastic material (also referred to as a thermoplastic) is a plastic which can be reversibly deformed in certain temperature ranges. Such a plastic is soft in comparison with a thermosetting plastic and can be deformed in the event of an impact and thus absorb at least some of the energy. By using a thermoplastic material as an (inner) second layer, together with an (outer) first layer of a thermosetting material, the impact energy on the radome is first transferred from the first layer to the second layer without the radome being irreversibly deformed. The second layer can then absorb the impact energy (or at least some of it) and convert it into heat without causing substantial irreversible changes in the material properties. This creates a mechanically stable radome.

When this disclosure refers to thermoplastic materials, these may comprise polyphenylene ethers (PPE), for example and without being limited thereto. In addition, the thermoplastic materials may be reinforced with short or continuous quartz or glass fibers.

According to one embodiment, the first dielectric constant is different from the second dielectric constant.

The electromagnetic properties of the overall radome can be adapted by adapting the second dielectric constant to the respective transmission and reception frequencies because the first dielectric constant is determined by the mechanical requirements and by the material of the first layer and, in the case of the second layer, a larger selection of materials, in particular as described further below, including thermoplastic materials, is possible.

In general, the dielectric constant or (relative) permittivity of a material is a complex variable having a real part and an imaginary part. Here, the real part determines the reflectivity and transmissivity of the signal at the material as well as the propagation path of a signal through the material (or the change in the propagation path at the transition from one layer to the next layer). The imaginary part describes the signal absorption within the material, is generally several orders of magnitude smaller than the real part and therefore has only a slight effect on the magnitude of the dielectric constant. When this disclosure refers to a dielectric constant, this always refers to the magnitude of the permittivity, which, owing to the different orders of magnitude of the real part and the imaginary part, substantially corresponds to the real part.

In this embodiment and in the other embodiments, the mechanical characteristic values (e.g. elastic constants, fracture-mechanical constants) of the materials of the individual layers may also be different.

According to a further embodiment, the radome furthermore has a third layer with a third dielectric constant. The third layer is arranged between the first layer and the second layer.

The third layer connects the first layer and the second layer to one another and, in particular, can be a foam core or a honeycomb core. However, this list is only illustrative and other materials are also conceivable.

According to a further embodiment, the third dielectric constant is less than the first dielectric constant and/or equal to or less than the second dielectric constant.

Materials with low dielectric constants are advantageous for electromagnetic transparency and for reducing dielectric loss. Therefore, materials with a dielectric constant as close as possible to 1, i.e. as close as possible to the dielectric constant of air, would be ideal for signal propagation through a radome, leading to very low dielectric losses, since in this way there is no large jump electromagnetically, i.e. abrupt change in the dielectric constant, at the junction and the electromagnetic wave does not undergo any attenuation during passage through the layers. However, such materials are generally not very stable mechanically. In contrast, materials with a high dielectric constant have a greater reflection coefficient at the layer surface and poorer electromagnetic transparency, but are typically more mechanically stable.

Since, as already explained, a higher mechanical strength is necessary for the (outer) first layer than for the (inner) second layer and for the third layer, it is advantageous for the overall properties of the radome if a lower dielectric constant is chosen for layers which are subjected to lower mechanical loads, such as the third layer located between the first layer and the second layer.

In addition, without limitation, the second dielectric constant can be less than the first dielectric constant since the second layer is also subjected to lower mechanical loads than the first layer.

According to a further embodiment, the third layer has a third layer thickness, which is different from the first layer thickness and from the second layer thickness.

As already described above, the layer thickness of the (outer) first layer is determined substantially by the mechanical requirements placed on the radome. The layer thicknesses of the (inner) second layer and of the third layer can therefore be adapted in such a way that the electromagnetic properties of the radome as a whole are adapted to the electromagnetic signal of the antenna, in particular to the frequency ranges used and the entry angles of the signals. In this way, the electromagnetic transparency and phase fidelity can be improved.

According to a further embodiment, the third layer comprises a thermoplastic material.

The third layer can thus absorb the energy from any impact event that occurs and in this way can additionally protect the second layer. This is advantageous particularly if the second layer thickness is less than the first layer thickness. However, even if the second layer comprises or is formed entirely from a thermoplastic material, the absorption of the impact energy is improved by a third layer made from a thermoplastic material.

According to a further embodiment, the radome furthermore has a fourth layer with a fourth dielectric constant and a fifth layer with a fifth dielectric constant. The fifth layer is arranged between the second layer and the fourth layer. The fifth dielectric constant is equal to the third dielectric constant and the fourth dielectric constant is equal to or less than the second dielectric constant.

In this embodiment, the fourth layer, in the installed state of the radome, corresponds to the innermost layer of the radome, which faces the antenna. The fifth layer serves as a connecting layer between the fourth layer and the second layer. By using two additional layers, the radome can be further adapted to the requirements of the antenna. Particularly in the case of complex antenna applications with different frequency ranges to be covered and high demands on an undisturbed signal for different entry angles, more complex layer structures with a plurality of layers are necessary.

According to a further embodiment, the fifth layer comprises a thermoplastic material.

Like the third layer, the fifth layer forms an inner layer, i.e. in particular a layer which is arranged between two mechanically stable layers. Such layers are used to adapt the electromagnetic properties of the radome, for example by selecting suitable layer thicknesses and suitable dielectric constants. In embodiments in which the third layer comprises a thermoplastic material, the fifth layer may comprise the same thermoplastic material. However, the fifth layer may also comprise another thermoplastic material, e.g. a thermoplastic material with a different dielectric constant.

According to a further embodiment, the fourth layer comprises a thermosetting material.

Since the fourth layer is the innermost layer of the radome, it can also be formed from a thermosetting material or comprise such a material in order to increase mechanical strength if this is necessary according to the application.

According to a further embodiment, the fourth layer has a fourth layer thickness, which is different from the first layer thickness or from the second layer thickness.

In general, all the layers of the radome can have different layer thicknesses. Taking into account the electromagnetic requirements for the signals used and the electromagnetic transitions through the different materials and the different dielectric constants between the individual layers, the radome can thus be adapted for a specific application in order to influence or distort the signal as little as possible.

However, it is also possible for individual layers to have an identical or similar layer thickness. However, in a preferred embodiment, the radome is always constructed asymmetrically with respect to the dielectric and/or mechanical characteristic values as regards the layer thicknesses and/or the materials used.

According to a further embodiment, the fifth layer has a fifth layer thickness, which is different from the third layer thickness.

According to a further embodiment, the first layer comprises glass fibers.

By using glass fibers in the first layer, it is possible to provide the first layer with further mechanical reinforcement. Since the first layer is the outermost layer of the radome, a high mechanical stability is necessary especially for this layer. However, other layers may also comprise glass fibers or may be reinforced with glass fibers.

The radome can have a surface coating on its outer surface, such as, for example, a layer of paint, an erosion layer or the like. Likewise, the radome can have on its inner surface a surface coating of the same material as or of a different material than the outer surface coating.

The layers of the radome are shaped to fit into one another. In this case, the layers are mechanically connected to one another, with the result that, as a rule, relative movement of the layers is not possible. The layers can be assembled dry and infiltrated with resin and cured. However, the layers can also be assembled from pre-impregnated plies, referred to as prepregs, and cured.

According to a further aspect, an aircraft having an antenna and an above-described radome is made available. The radome is arranged over the antenna. The first layer of the radome is arranged on a side of the radome facing away from the antenna. The radome covers the antenna and protects the antenna from external influences.

In this case, the radome can be constructed according to any of the above-described embodiments of the radome. The antenna may be any type of antenna used on an aircraft, such as, but not limited to, a communications antenna, a weather radar, or a military radar antenna. An antenna in the sense of the disclosure can also be understood to mean a plurality of individual antennas or an array of antennas. In general, such an antenna is a transmitter and/or receiver of electromagnetic waves.

In summary, the invention thus makes available a radome for various antenna applications which meets the mechanical requirements, for example due to aerodynamic loads and bird strike events. Modern transmission and reception technology also makes the requirements on such radomes increasingly demanding from an electromagnetic point of view. The asymmetrical radome design disclosed herein, and in particular also the use of thermoplastic materials, not used hitherto in the prior art, contribute to facilitating the satisfaction of these electromagnetic requirements. In addition, the asymmetrical radome design contributes to improvements in the mechanical properties of the radome. In this case, the electromagnetic properties of the radome for complex antenna applications can be adapted to the respective signals by varying the layer thicknesses and the dielectric constants used.

BRIEF DESCRIPTION OF THE DRAWINGS

Exemplary embodiments are explained in greater detail below with reference to the attached drawings. The illustrations are schematic and not to scale. Identical reference signs refer to identical or similar elements. More specifically.

DETAILED DESCRIPTION

Figure 1:
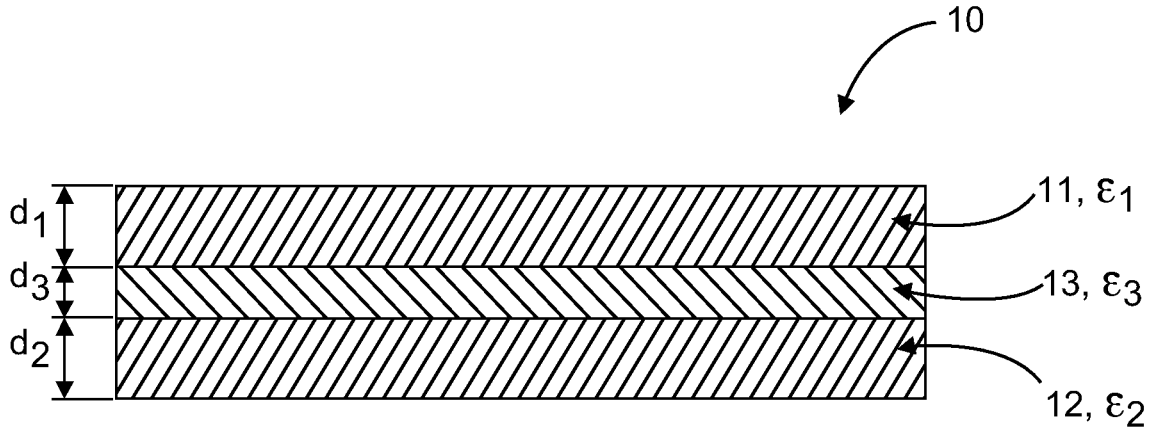
FIG. 1 shows a schematic sectional illustration of an asymmetrically constructed three-layer radome according to one exemplary embodiment.

FIG. 1 shows a schematic sectional illustration of the layers of an asymmetrical radome 10 according to one exemplary embodiment. The radome 10 has a first layer 11 with a first dielectric constant $\varepsilon_1$ and a first layer thickness $d_1$, a second layer 12 with a second dielectric constant $\varepsilon_2$ and a second layer thickness $d_2$, and a third layer 13 with a third dielectric constant $\varepsilon_3$ and a third layer thickness $d_3$. The third layer 13 is arranged between the first layer 11 and the second layer 12 and connects them to one another.

Figure 3:
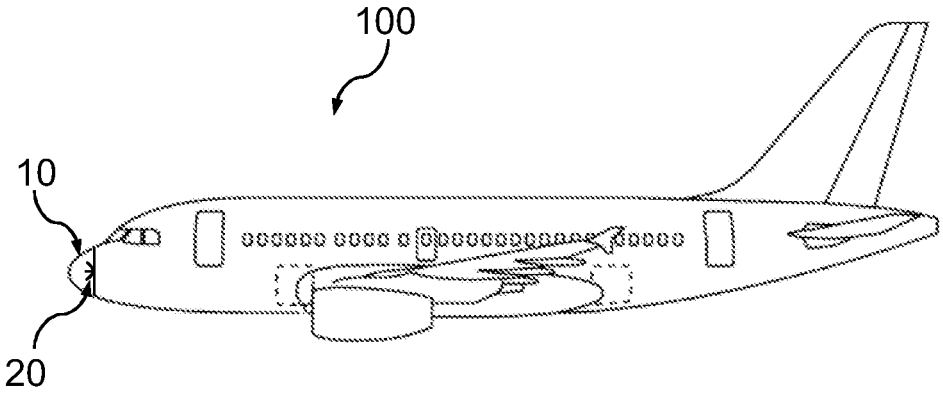
FIG. 3 shows a schematic illustration of an aircraft having an antenna and an asymmetrically constructed radome disclosed herein, according to one embodiment.

The first layer 11 corresponds to the outside of the radome, i.e. in FIG. 3 the side facing away from the antenna 20 and the aircraft 100, and is formed from a thermosetting material, in particular from a cyanate ester resin or an epoxy resin reinforced with short or continuous quartz or glass fibers. As a result, the first layer 11 is mechanically very stable and withstands a bird strike or hail, for example, without being permanently deformed or broken. However, the first layer 11 does not absorb the impact energy, or does so only slightly, instead passing on the impact pressure and thus the impact energy via shock waves to the third layer 13 and the second layer 12. The first layer thickness $d_1$ is determined by the mechanical requirements placed on the radome 10 and is designed in such a way that it withstands the aerodynamic loads and also any dynamic loads which may occur, such as those which result from bird strikes. In particular, the first layer thickness $d_1$ is thus designed to withstand loads that are likely to occur, a certain safety margin being taken into consideration at the same time.

The second layer 12 is formed from a thermoplastic material, more specifically from a polyphenylene ether (PPE) reinforced with short or continuous quartz or glass fibers. This material is softer than the first layer 11 and can deform. As a result, the second layer 12 can absorb the impact energy which it receives from the first layer 11 (via the third layer 13).

The third layer 13 is likewise formed from a thermoplastic material but has a lower mechanical strength than the second layer 12 since, in contrast to the first layer 11 and the second layer 12, this second layer does not represent a surface of the radome 10 and therefore has to withstand mechanical loads to a lesser extent. The third layer 13 is enclosed by the first layer 11 and the second layer 12 and therefore has no direct contact with the outside. Since the third layer 13 is the softest layer of the radome 10, it absorbs a large part of the energy during impact events. The remaining energy is passed on to the second layer 12 and can be absorbed by the latter. The interface between the first layer 11 (thermosetting plastic) and the third layer 13 (thermoplastic) furthermore reduces the reflection of shock waves produced at the first layer 11 and thus reduces delamination damage.

Mechanically more stable materials generally have a higher dielectric constant. Since the first layer 11 and the second layer 12 correspond to (outer and inner) surfaces of the radome 10, they therefore have higher dielectric constants $\varepsilon_1$, $\varepsilon_2$ than the third layer 13. In particular, the first layer 11 has the highest dielectric constant $\varepsilon_1$ since this must be mechanically the most stable as an outward-facing layer. The second dielectric constant $\varepsilon_2$ is less than the first dielectric constant $\varepsilon_1$ but greater than the third dielectric constant $\varepsilon_3$.

The first layer thickness $d_1$, the second layer thickness $d_2$ and the third layer thickness $d_3$ each differ from one another and are adapted in such a way as to achieve the necessary electromagnetic properties (transmission, reflection, phase fidelity, dielectric loss, distortion of the antenna pattern, etc.) of the radome 10 for the respective antenna application. The use of the thermoplastic layers 12, 13 having a low dielectric constant improves the electromagnetic performance of the radome 10 with respect to the entry phase delay and the antenna axial ratio and thus reduces directional errors and pattern distortions.

Although a radome 10 with three layers 11, 12, 13 is illustrated in FIG. 1, this embodiment is merely an example. The radome 10 can also have just two layers. In this case, the layer thickness of the (outer) first layer 11 is determined by the mechanical requirements, and the (inner) second layer 12 is adapted to meet the respective electromagnetic requirements.

Figure 2:
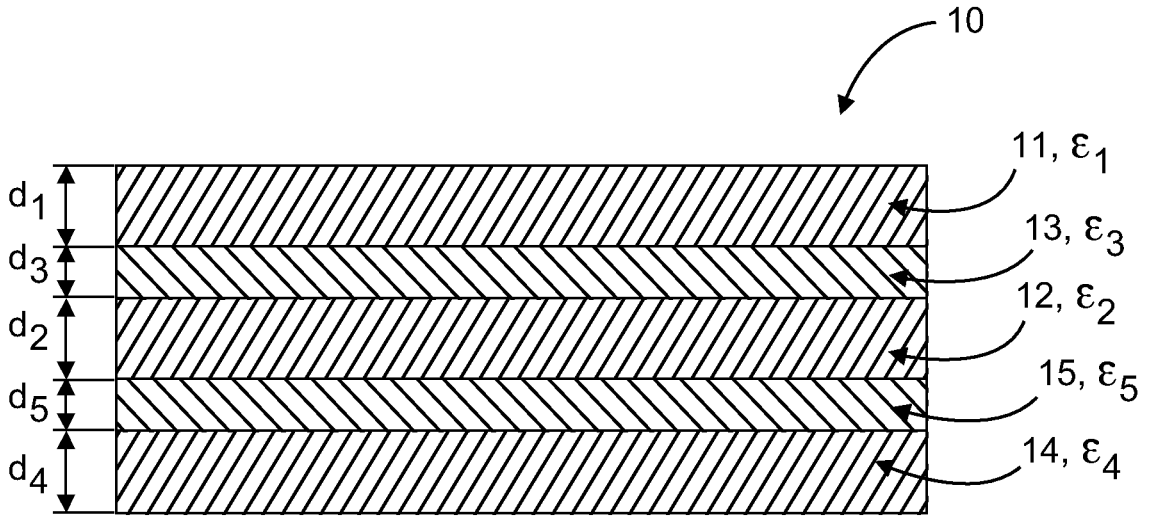
FIG. 2 shows a schematic sectional illustration of an asymmetrically constructed five-layer radome according to one exemplary embodiment.

FIG. 2 shows a radome 10 similar to that in FIG. 1. However, this radome 10 additionally has a fourth layer 14 with a fourth layer thickness $d_4$ and a fourth dielectric constant $\varepsilon_4$ as well as a fifth layer 15 with a fifth layer thickness $d_5$ and a fifth dielectric constant $\varepsilon_5$. The fourth layer 14 and the fifth layer 15 are each arranged inside the second layer 12 (in the direction of the antenna 20 in the installed state of the radome 10), wherein the fifth layer 15 lies between the second layer 12 and the fourth layer 14.

The fifth layer 15 can be formed from the same material as the third layer 13, i.e. $\varepsilon_5$ is of the same size as $\varepsilon_3$, and the fourth layer 14 can be formed from the same material as the second layer 12, i.e. $\varepsilon_4$ is of the same size as $\varepsilon_2$. However, in the radome 10 illustrated, the second layer 12 can also be formed from the same material as the first layer 11. In other words, the central layer (the second layer 12) is formed either from the same material as the outermost layer (first layer 11) or as the innermost layer (fourth layer 14). However, the layers 11, 12, 13, 14 and 15 have different layer thicknesses $d_1$, $d_2$, $d_3$, $d_4$ and $d_5$. The thermoplastic intermediate layers, i.e. the third layer 13 and the fifth layer 15, each have lower dielectric constants $\varepsilon_3$, $\varepsilon_5$ than the remaining layers 11, 12, 14. However, other ratios of the dielectric constants to one another are also conceivable.

This structure permits a high mechanical stability (the thermoplastic intermediate layers serve as energy absorbers) with simultaneously advantageous electromagnetic properties of the radome 10 due to the low dielectric constants of the thermoplastic intermediate layers. By selecting suitable materials and layer thicknesses of such an asymmetrical radome, the electromagnetic properties can furthermore be adapted to the desired antenna application, in particular to the frequency ranges used and to different requirements in the transmission and reception modes.

It should be noted that, depending on the application and complexity of the application, there can also be more than three or five layers in the radome 10. In addition, it should be recognized that the layer structures in FIGS. 1 and 2 show only sections of a radome, and the radome is usually not designed to be flat but as a rule has a curved, for example parabolic, surface, allowing the radome 10 to be attached to the nose of an aircraft (such as the aircraft 100 from FIG. 3), for example. However, the radome 10 can also be designed to be flat, e.g. in order to cover an antenna arranged in a depression in the outer wall of an aircraft and to form a flush surface of the aircraft toward the outside.

FIG. 3 shows a schematic illustration of an aircraft 100 according to one exemplary embodiment. The aircraft 100 has an antenna 20 on the outside of the aircraft 100. A radome 10 covers the antenna 20.

The antenna 20 can be any conceivable transmitting and receiving device for electromagnetic signals, such as, for example, a communications antenna or a radar antenna.

The radome 10 covers the antenna 20 in such a way as to protect it from environmental influences such as, for example, aerodynamic loads, the effects of weather and bird strikes. The radome 10 can be constructed according to any of the embodiments disclosed herein.

Although FIG. 3 illustrates just one antenna 20 with one radome 10, the aircraft can also have more than one antenna 20 and more than one radome 10. In this case, the antennas 20 with the associated radomes 10 can be located at any conceivable and possible point on the aircraft 100. Moreover, it is also possible to cover more than one antenna 20 or antenna array with just one radome 10.

In addition, it should be noted that "comprising" or "having" does not exclude other elements or steps and "a" or "an" does not exclude a multiplicity. Furthermore, it should be noted that features or steps which have been described with reference to one of the above exemplary embodiments can also be used in combination with other features or steps of other exemplary embodiments described above. Reference signs in the claims are not to be regarded as a restriction.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

LIST OF REFERENCE SIGNS

10 antenna radome
11 first layer
12 second layer
13 third layer

14 fourth layer
15 fifth layer
$\varepsilon_1$ first dielectric constant
$\varepsilon_2$ second dielectric constant
$\varepsilon_3$ third dielectric constant
$\varepsilon_4$ fourth dielectric constant
$\varepsilon_5$ fifth dielectric constant
$d_1$ first layer thickness
$d_2$ second layer thickness
$d_3$ third layer thickness
$d_4$ fourth layer thickness
$d_5$ fifth layer thickness
20 antenna
100 aircraft

The invention claimed is:

1. A radome for an aircraft, wherein the radome comprises:
a first layer with a first dielectric constant;
a second layer with a second dielectric constant;
a third layer with a third dielectric constant;
a fourth layer with a fourth dielectric constant; and
a fifth layer with a fifth dielectric constant;
wherein the first layer and the second layer have different first and second layer thicknesses, respectively;
wherein the third layer is arranged between the first layer and the second layer;
wherein the first layer comprises a thermosetting material;
wherein the second layer comprises a thermoplastic material;
wherein the fifth layer is arranged between the second layer and the fourth layer;
wherein the fifth dielectric constant is equal to the third dielectric constant; and
wherein the fourth dielectric constant is equal to or less than the second dielectric constant.

2. The radome as claimed in claim 1, wherein the first dielectric constant is different from the second dielectric constant.

3. The radome as claimed in claim 1, wherein the third dielectric constant is less than the first dielectric constant and/or less than or equal to the second dielectric constant.

4. The radome as claimed in claim 1, wherein the third layer has a third layer thickness, which is different from the first layer thickness and from the second layer thickness.

5. The radome as claimed in claim 1, wherein the third layer comprises a thermoplastic material.

6. The radome as claimed in claim 1, wherein the fifth layer comprises a thermoplastic material.

7. The radome as claimed in claim 1, wherein the fourth layer comprises a thermosetting material.

8. The radome as claimed in claim 1, wherein the fourth layer has a fourth layer thickness, which is different from the first layer thickness or from the second layer thickness.

9. The radome as claimed in claim 1, wherein the fifth layer has a fifth layer thickness, which is different from the third layer thickness.

10. The radome as claimed in claim 1, wherein the first layer comprises glass fibers.

11. An aircraft comprising:
an antenna; and
a radome as claimed in claim 1;
wherein the radome is arranged over the antenna;
wherein the first layer of the radome is arranged on a side of the aircraft facing away from the antenna; and
wherein the radome covers the antenna and protects the antenna against external influences.

* * * * *